US011337508B2

(12) United States Patent
Austin

(10) Patent No.: US 11,337,508 B2
(45) Date of Patent: May 24, 2022

(54) HAT SECURING BACKPACK AND A METHOD FOR ITS USE

(71) Applicant: Joey D. Austin, Spring Branch, TX (US)

(72) Inventor: Joey D. Austin, Spring Branch, TX (US)

( * ) Notice: Subject to any disclaimer, the term of this patent is extended or adjusted under 35 U.S.C. 154(b) by 0 days.

(21) Appl. No.: 16/237,745

(22) Filed: Jan. 1, 2019

(65) Prior Publication Data

US 2019/0380474 A1 Dec. 19, 2019

Related U.S. Application Data

(60) Provisional application No. 62/613,022, filed on Jan. 2, 2018.

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC . A45F 2003/003; A45F 2003/001; A45F 3/04
See application file for complete search history.

(56) References Cited

U.S. PATENT DOCUMENTS 2,319,747 A * 5/1943 Osborne ..... B60R 7/08 211/31
6,290,114 B1 * 9/2001 Berberian ..... A45F 3/04 224/637
2002/0113102 A1 * 8/2002 Klamm ..... A45C 7/0077 224/153
2004/0099704 A1 * 5/2004 Zion ..... A45F 3/08 224/576
2004/0118891 A1 * 6/2004 Esqueda ..... A42B 3/006 224/639
2009/0206118 A1 * 8/2009 Sabbah ..... A45C 13/02 224/652
2011/0180575 A1 * 7/2011 Abramowitz ..... A45C 15/00 224/259
2012/0286011 A1 * 11/2012 Wegener ..... A45C 13/02 224/627

* cited by examiner

*Primary Examiner* — Scott T McNurlen
(74) *Attorney, Agent, or Firm* — Muskin & Farmer, LLC

(57) ABSTRACT

A backpack having a hat securing strap system to secure a hat onto the backpack when the hat is not being worn. The present backpack can have a front backpack section with shoulder straps, a middle backpack section having one or more storage compartments, and a rear backpack section wherein the hat securing strap system secures the hat. This hat securing strap system can be made up of three parts: a top section, a middle section, and a bottom section. The middle section can have parallel straps which are designed to pass around the crown of a hat while holding the brim of the hat against the rear backpack section. The top section and bottom section of the hat securing strap can attach to the backpack using a buckle or similar fastening mechanism. The hat securing strap system can be stored in a zippered storage pouch attached to the bottom of the backpack.

10 Claims, 5 Drawing Sheets

FIG. 4
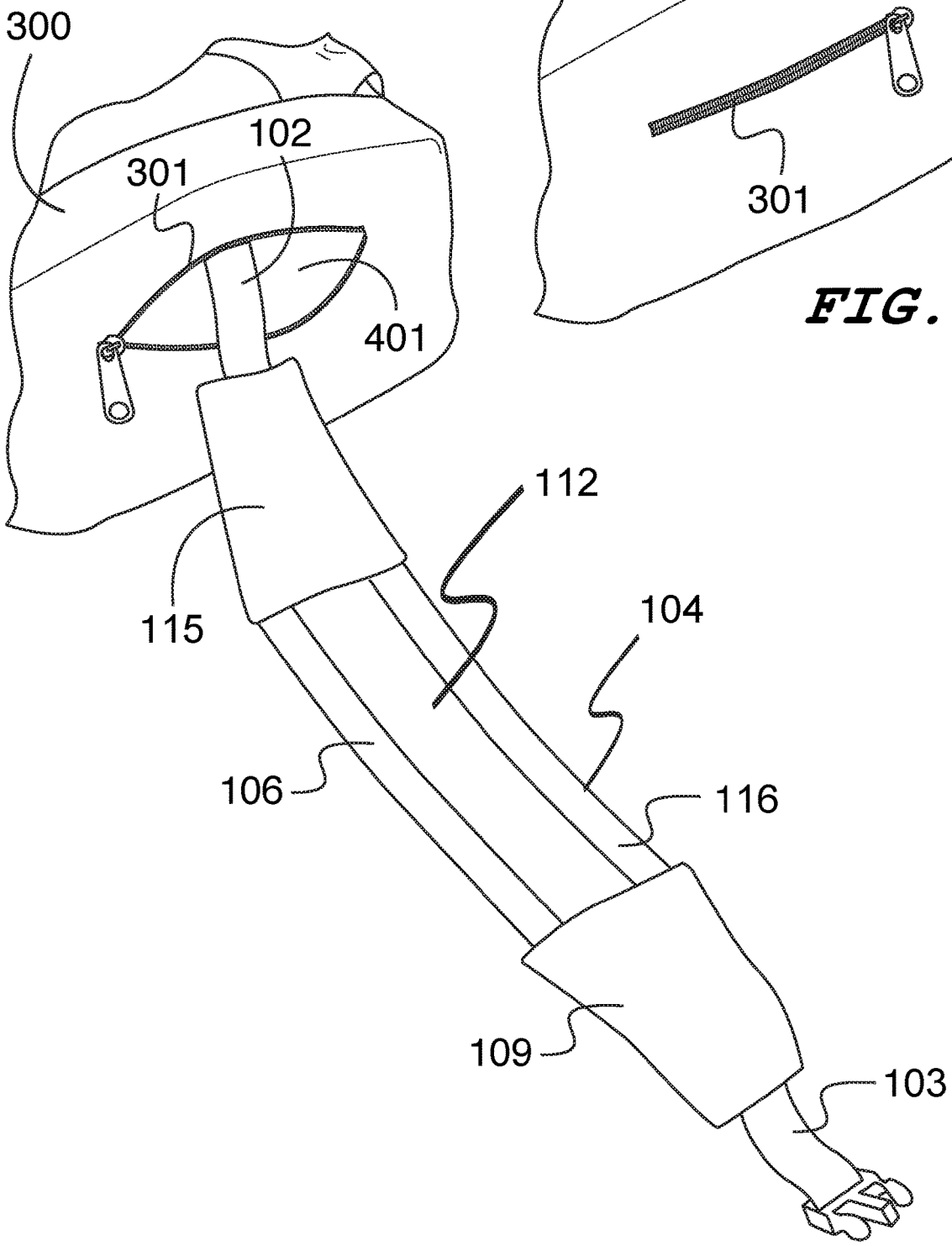
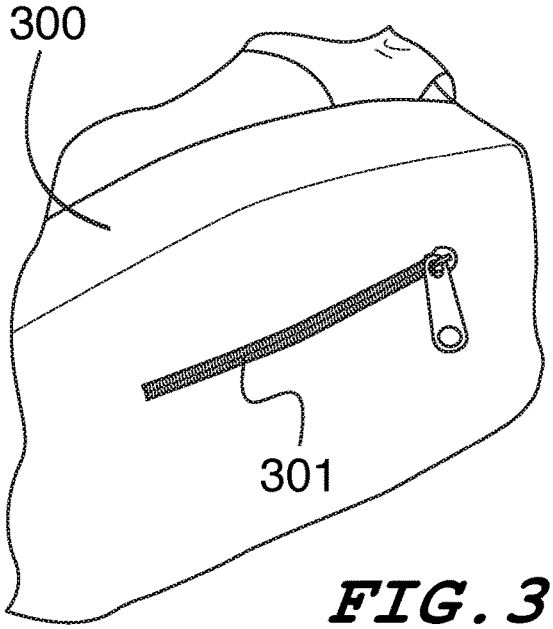
FIG. 3

HAT SECURING BACKPACK AND A METHOD FOR ITS USE

CROSS-REFERENCE TO RELATED APPLICATIONS

This application claims benefit to provisional patent application 62/613,022 filed Jan. 2, 2018, which is incorporated by reference herein in its entirety.

FIELD OF THE INVENTION

The present device relates to backpacks or similar baggage, which comprise devices for securing headwear onto them.

BACKGROUND

Expensive hats are often misplaced or lost when they are not being worn. To avoid losing such hats, the owners will sometimes store them in a bag or backpack, where they may become disfigured, damaged or even ruined. The hats commonly referred to as "cowboy hats" can become completely distorted or lose shape when too much pressure is placed on the crown or brim of such hats. Furthermore, such hats are commonly worn by people living active lifestyles, including outdoor activities, thus increasing the likelihood that the hat will be damaged or destroyed. Though there are some portable hat carriers available in the prior art, they are often made up of rigid stands or are a caddy style which must be carried separately, neither of which are suitable for use with bags or backpacks.

What is needed is a hat securing backpack comprising a hat securing system, which can be deployed to allow the user to securely affix a hat onto the backpack when it is not being worn in such a way that the hat, including its crown and brim, is not crushed or otherwise deformed by the contents of the backpack, but also in a way that allows the user to conveniently detach the hat when needed.

SUMMARY OF THE INVENTION

It is an aspect of the present hat securing backpack to comprise a hat securing system that can secure a hat onto the backpack when the hat is not being worn, thus protecting the hat from becoming distorted or disfigured when secured to the hat securing device.

The above aspect can be achieved by a hat securing backpack comprising: a middle backpack section comprising one or more storage compartments; a front backpack section comprising one or more shoulder straps; a rear backpack section on the side of the middle backpack section opposite the front backpack section; a backpack top; a backpack bottom; and a hat securing strap system connected to the backpack top and the backpack bottom over the rear backpack section, wherein the hat securing strap system comprises a bottom section connected to the backpack bottom, a top section connects to the backpack top, wherein the top section and the bottom section are joined by a middle section having a first connector and a second connector, each connected together by two or more parallel straps, wherein an opening exists between the two or more parallel straps.

BRIEF DESCRIPTION OF THE DRAWINGS

Further features and advantages of the present device, as well as the structure and operation of various embodiments of the present device, will become apparent and more readily appreciated from the following description of the preferred embodiments, taken in conjunction with the accompanying drawings of which:

FIG. 3 is a partial, perspective rear view of the rear backpack section and backpack bottom of a hat securing backpack comprising a hat securing strap system, as shown in FIGS. 1 and 2, wherein the hat securing backpack comprises a storage pouch, according to an embodiment;

FIG. 4 is a partial, perspective rear view of the rear backpack section and backpack bottom of the hat securing backpack comprising a hat securing strap system, shown in FIGS. 1, 2 and 3, wherein the bottom of a hat securing strap has been deployed from the storage pouch, according to an embodiment;

DETAILED DESCRIPTION

Figure 1:
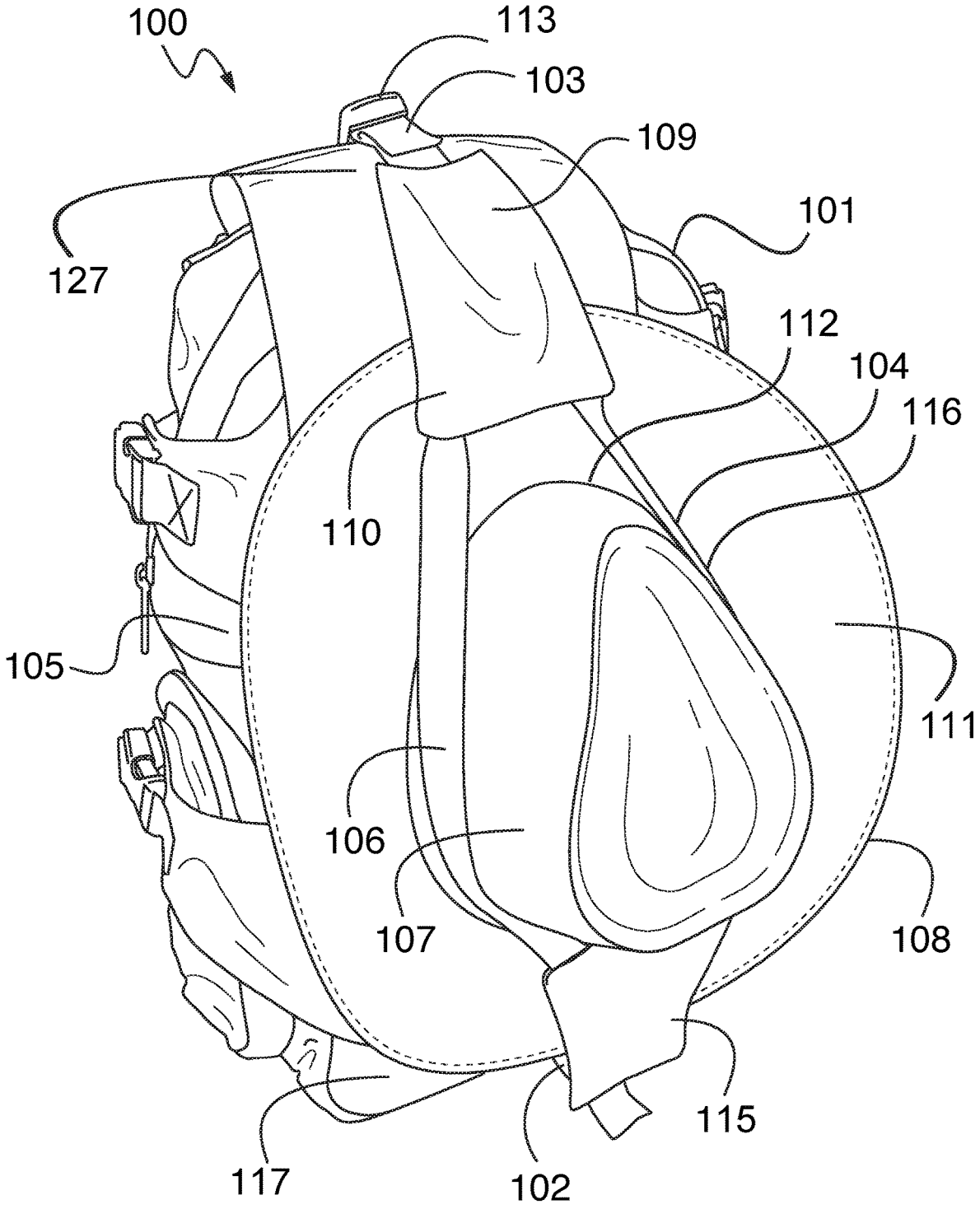
FIG. 1 is a perspective top, rear and side view of a hat securing backpack comprising a hat securing strap system, wherein a hat securing strap system is shown in a deployed configuration, according to an embodiment.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The present hat securing backpack can be configured to secure a hat onto the rear backpack section of the backpack in such a way that the hat, including its crown and brim, is not crushed or otherwise damaged. The present hat securing backpack is specifically designed for hats comprising a crown and a medium or broad brim, such as stetson hats, sombreros, fedoras, or campaign hats, just to name a few.

According to an embodiment, this can be accomplished using straps or similar attaching devices to connect the hat to the exterior of the hat securing backpack. By attaching the hat to the exterior of the backpack, it can be separated from the contents of the backpack so that those contents do not exert pressure on the hat sufficient to harm it, while the backpack is being worn. This embodiment also allows the hat to be secured and detached without disturbing the contents of the backpack in any way. Specifically, the hat can be connected to the backpack using a hat securing strap system, which can be deployed when in use and stored out of the way when not in use, according to an embodiment.

According to an embodiment, the rear of the present hat securing backpack can comprise a cover to provide a flat surface to receive the underside of a hat's brim. The opposite side of the backpack, the front backpack section, will remain free and available for use against the back of the user, allowing a user to simultaneously wear the backpack and secure a hat on the rear of the backpack. In an embodiment, the hat securing strap system can comprise a quick-release mechanism located on one end of the hat securing strap system allowing the hat to be released quickly and easily. In an embodiment, the hat securing strap system can comprise parallel straps used to secure the brim on either side of the crown of a hat. When not in use, the hat securing strap system can be conveniently stored in a storage pouch, which can be integrated near the backpack bottom according to an embodiment.

Reference will now be made in detail to the present embodiments of the invention, examples of which are illustrated in the accompanying drawings.

FIG. 1 is a perspective top, rear and side view of a hat securing backpack 100 comprising a hat securing strap system 110 in a deployed configuration, according to an embodiment. In an embodiment, the present hat securing backpack 100 can comprise a typical backpack, having shoulder straps on its front backpack section (not visible in FIG. 1) and a middle backpack section 101 having one or more storage compartments located behind the shoulder straps and the front backpack section, and a rear backpack section 105 located behind the middle backpack section 101. According to an embodiment, the hat securing strap system 110, can be used to secure a hat to the rear backpack section 105.

According to an embodiment, the hat securing strap system 110 can comprise three sections. A bottom section 102 can be either be removably or irremovably connected near the backpack bottom 117 of the present hat securing backpack 100. In an embodiment, the connection point, where the bottom section 102 connects to the backpack bottom 117 can be located within a storage pouch (not shown in FIG. 1) which can be incorporated into the hat securing backpack 100 or be attachable to it.

The bottom section 102 of the hat securing strap system 110 can be connected to a middle section 104, which can be comprised of a first parallel strap 106 and a second parallel strap 116, which can form an opening 112 between them of sufficient size and shape to allow the crown 107 of a hat 108 to fit between the two parallel straps, 106 and 116, according to an embodiment. Similarly, the two parallel straps, 106 and 116, must be of sufficient strength and dimensions so that each may hold the brim 111 of the hat 108 securely against the rear backpack section 105 of the present hat securing backpack 100 when the hat securing strap system 110 is fully deployed as shown in FIG. 1. According to the embodiment shown in FIG. 1, the straps 106 and 116 are narrow and flat and can be comprised of fabric, leather, or any other suitable material. The top section 103 of the hat securing strap system 110 can be securely connected to the middle section 104 opposite the bottom section 102 and then also connect to the backpack top 127 of the present hat securing backpack 100. In the embodiment shown in FIG. 1, the top section 103 can comprise a quick release buckle 113 which may comprise a length adjustment mechanism allowing the user to adjust the tension with which the hat securing strap system 110 holds the hat 108 against the rear backpack section 105 of the present hat securing backpack 100.

The top section 103 of the hat securing strap system 110 can be connected to the bottom section 102 by the middle section 104. According to an embodiment, the middle section 104 can be comprised of a first connector 109 connected to one end of each parallel strap, 106 and 116, and a second connector 115 connected to an opposite end of each parallel strap, 106 and 116. According to an embodiment, the first connector 109 can be configured such that tension from the first parallel strap 106 and second parallel strap 116 can be transmitted through the first connector 109 to the top section 103. Similarly, the second connector 115 can be configured such that tension from the first parallel strap 106 and second parallel strap 116 can be transmitted through the second connector 115 to the bottom section 103. Additionally, where the first parallel strap 106 and second parallel strap 116 connect to the first connector 109, the points of connection can be far enough apart to create the opening 112 between them sufficient for the crown 107 of a hat 108 to pass between the first parallel strap 106 and second parallel strap 116. While there is a first parallel strap 106 and second parallel strap 116 on either side of the crown 107 of the hat 108 depicted in the figures, it is contemplated that any number of parallel straps or any shape of parallel straps could be used so long as said straps are sufficient to secure the brim 111 on either side of the crown 107 of a hat 108 to the rear backpack section 105 of the backpack 100.

Figure 2:
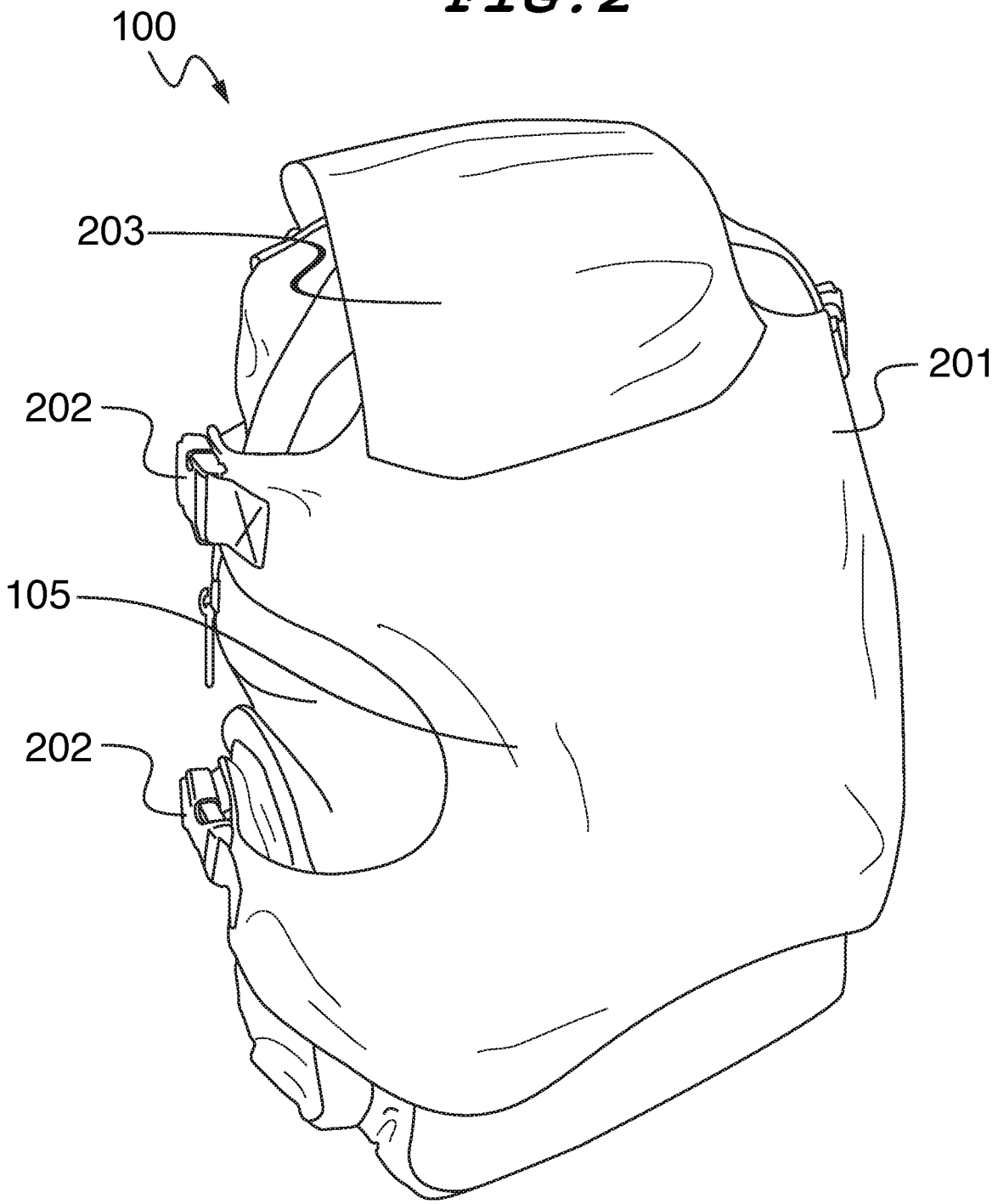
FIG. 2 is a perspective top, rear and side view of the hat securing backpack comprising a hat securing strap system shown in FIG. 1, wherein the hat securing strap system (not pictured) in a stowed configuration according to an embodiment.

FIG. 2 is a perspective top, rear and side view of a hat securing backpack 100 having a hat securing hat system 110 (not shown in FIG. 2) in a stowed configuration, according to an embodiment. In an embodiment, the hat securing strap system 110 can be contained within a storage pouch (not shown in FIG. 2 but shown as 300 in FIG. 3) for deployment when needed. In an alternative embodiment, the hat securing strap system 110 can be entirely detachable from the present hat securing backpack 100.

According to an embodiment, the hat securing backpack 100 can also comprise a cover 201 which can be used to cover the rear backpack section 105 of the hat securing backpack 100. In an embodiment, this cover 201 can be either water-resistant or waterproof in order to protect the hat securing backpack 100 from rain or other moisture or debris. This cover 201 can be comprised of polyester, plastic, or any other suitable material, according to an embodiment. In an embodiment, the cover 201 can provide a flat surface configured to receive the underside of the brim 111 of a hat 108 when the hat securing strap system 110 is in the deployed configuration, as shown in FIG. 1. In an embodiment, the cover 201 can comprise one or more cover buckles 202 connected at various points to the cover 201, allowing it to be removably connected over the rear backpack section 105 of the hat securing backpack 100.

Figure 5:
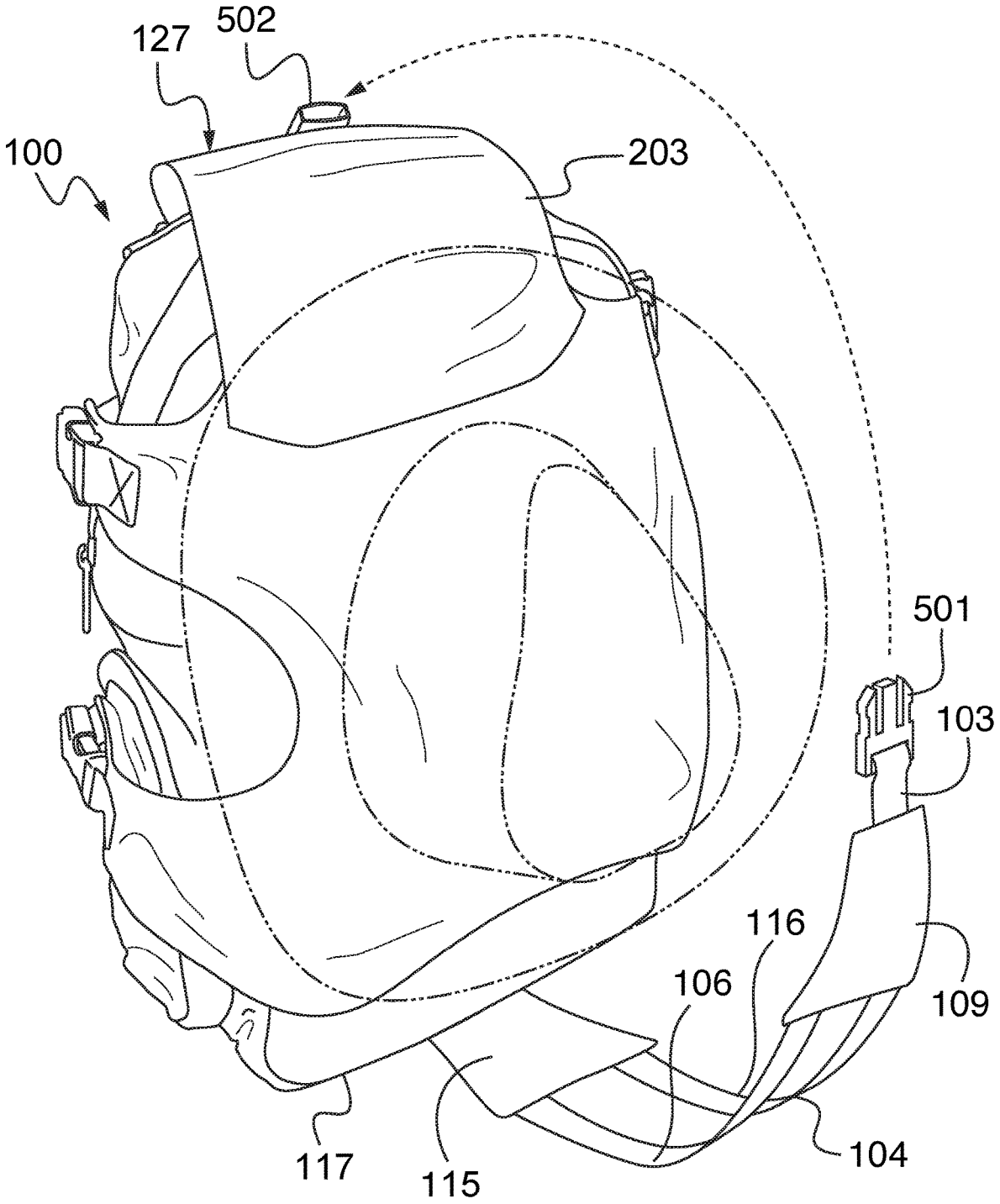
FIG. 5 is a perspective top, rear and side view of a hat securing backpack comprising a hat securing strap system in a deployed configuration wherein the hat securing strap system has been deployed from the storage pouch, but has not yet been connected to the backpack top to secure the hat to the hat securing backpack, according to an embodiment.

In an embodiment, the backpack 100 can also comprise a rain flap 203, which can further protect the rear backpack section 105 of the present hat securing backpack 100. According to an embodiment, in a deployed configuration, the hat securing strap system 110 can be secured above the rain flap 203. However, as shown in FIG. 5, the rain flap 203 can still be used to cover the brim 111 of the hat 108, such that rain or other debris will be repelled by the rain flap 203 instead of running into the inside of the hat 108.

FIG. 3 is a partial, perspective bottom and rear view of hat securing backpack 100, shown in FIGS. 1 and 2, wherein the backpack bottom 117 comprises a storage pouch 300, according to an embodiment. The pouch 300 can be integrated into the backpack 100 or attached onto it, typically near the backpack bottom 117. According to an embodiment, a zippered opening 301, or any other suitable opening, on the pouch 300, which can be opened to allow the hat securing strap system 110 to move into and out from the pouch 300. According to an embodiment, the hat securing strap system 110 can be placed within the pouch 300 when it is not in use.

FIG. 4 is a partial, perspective bottom and rear view of the hat securing backpack 100, as shown in FIG. 3, wherein the hat securing strap system 110 has been deployed from the storage pouch 300, according to an embodiment. In an embodiment, the bottom section 102 of the hat securing strap system 110 can attach to the inside 401 of the storage pouch 300. In an alternative embodiment, the hat securing strap system 110 can be detachable from the storage pouch 300 and from the backpack 100 entirely.

FIG. 4 also clearly shows the three distinct sections comprising the hat securing strap system 110 according to an embodiment. Specifically, FIG. 4 clearly shows the bottom section 102, the middle section 104 and the top section 103, and the parts comprising each section, according to an embodiment. Regarding the middle section 104, the connection of the first parallel strap 106 and a second parallel strap 116 to the first connector 109 and second connector 115 to form the opening 112 between them.

FIG. 5 is a perspective top, rear and side view of the hat securing backpack 100 in a deployed configuration wherein the hat securing strap system 110 has been deployed from the storage pouch 300 (not visible in FIG. 5) but has not yet been connected to the backpack top 127 to secure the hat 108 in place, according to an embodiment. In an embodiment, a male buckle section 501 can be connected to the top section 103 of the hat securing strap system 110. This male buckle section 501 can be comprised of a plastic, metal or other suitable material. According to an embodiment, the male buckle section 501 can be configured to be inserted into female buckle section 502 that can be connected to the backpack top 127. In an embodiment, the male buckle section 501 can comprise quick release hardware consisting of either a side-squeeze or center-push mechanism. Therefore, the male buckle section 501 could be removed from the female buckle section 502 when both sides of the male buckle section 501 are released, or a center button is pushed, according to an embodiment. (FIG. 5 shows a male buckle section 501 comprising side-squeeze lock mechanism.)

Figure 6:
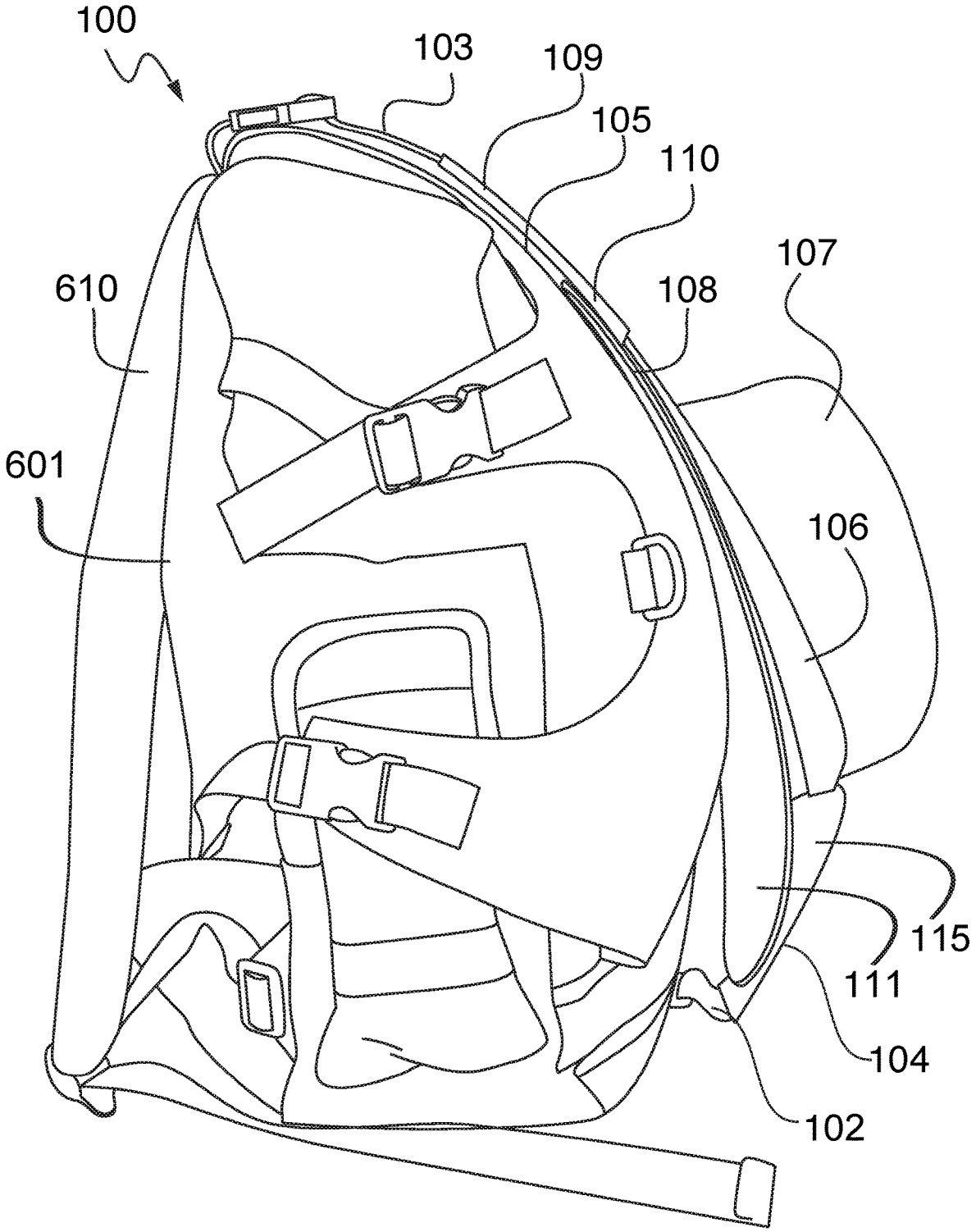
FIG. 6 is a side view of a hat securing backpack comprising a hat securing strap system in a deployed configuration wherein the hat securing strap system has been deployed from the storage pouch and connected to the backpack top to secure the hat to the hat securing backpack, according to an embodiment.

FIG. 6 is a side view of the hat securing backpack 100 comprising a hat securing strap system 110 in a deployed configuration wherein the hat securing strap system 110 has been deployed from the storage pouch 300 (not clearly visible in FIG. 6) and has been connected to the backpack top 127 to secure a hat 108 in place, according to an embodiment. In this side view, the only newly visible parts of the hat securing backpack 100 are the shoulder straps 610 located on the front backpack section 601. Additionally, this view shows a side view of the various parts comprising the hat securing strap system 110 as deployed to secure a hat 108, according to an embodiment. Specifically, viewable in FIG. 6 are the top section 103, the middle section 104, further comprising the first connector 109, the first parallel strap 106 (the second parallel strap 116 is not visible in FIG. 6), the second connector 115, and the bottom section 102. This view shows the relation of each to the crown 107 of the secured hat 108. Specifically, this view shows how the bottom section 102 and the second connector 115 can be of sufficient length to exceed the width of the brim 111 so that it can connect to the backpack 100.

The many features and advantages of the inventive concept are apparent from the detailed specification and, thus, it is intended by the appended claims to cover all such features and advantages of the concept that fall within its true spirit and scope. Further, since numerous modifications and changes will readily occur to those skilled in the art, it is not desired to limit the inventive concept to the exact construction and operation illustrated and described, and accordingly all suitable modifications and equivalents may be resorted to, falling within the scope of the inventive concept.

What is claimed is:

1. A hat securing backpack comprising:

a middle backpack section comprising one or more storage compartments;

a front backpack section comprising one or more shoulder straps;

a rear backpack section on the side of the middle backpack section opposite the front backpack section;

a backpack top facing upwards;

a backpack bottom facing downwards;

a hat securing strap system connected to the backpack top and the backpack bottom and extending over the rear backpack section, wherein the hat securing strap system comprises a bottom section directly connected only to the backpack bottom, a top section directly connected only to the backpack top, wherein the top section and the bottom section are joined by a middle section having a first connector connected to the top section and a second connector connected to the bottom section, wherein the first connector and the second connector are connected together by two or more parallel straps, wherein at least one opening exists between the two or more parallel straps; and wherein the rear backpack section comprises a cover for covering the rear backpack section, and wherein the backpack top comprises a rain flap extending downward from the backpack top, wherein both the rain flap and the cover are waterproof and the rain flap and the cover overlap to provide rain protection for both the hat and rear backpack section.

2. The hat securing backpack as recited in claim 1, wherein the top section of the hat securing strap system comprises a buckle.

3. The hat securing backpack as recited in claim 1, wherein a storage pouch configured to contain the hat securing strap system is incorporated into the backpack bottom.

4. The hat securing backpack as recited in claim 3, wherein the bottom section of the hat securing strap system is detachable from the storage pouch.

5. The hat securing backpack as recited in claim 3, wherein the storage pouch comprises a zippered opening.

6. The hat securing backpack as recited in claim 1, wherein the opening between the two or more parallel straps is configured to contain the crown of a hat.

7. The hat securing backpack as recited in claim 1, wherein the length of the top section of the hat securing strap system is adjustable.

8. The hat securing backpack as recited in claim 1, wherein the length of the bottom section of the hat securing strap system is adjustable.

9. The hat securing backpack as recited in claim 1, wherein the top section of the hat securing strap system comprises a male buckle section and the backpack top comprises a female buckle section configured to receive the female buckle section.

10. The hat securing backpack as recited in claim 1, wherein the cover comprises at least one cover buckle connected to the cover.

* * * * *